United States Patent [19]

Martin

[11] 4,400,956

[45] Aug. 30, 1983

[54] SKELETON KEY KIT

[75] Inventor: William E. Martin, Hamilton, Canada

[73] Assignee: Martin & Starchuk Limited, Dundas, Canada

[21] Appl. No.: 290,037

[22] Filed: Aug. 5, 1981

[51] Int. Cl.[3] ..... E05B 19/20

[52] U.S. Cl. ..... 70/394; 70/395; 70/409; 33/174 F

[58] Field of Search ..... 70/394, 395, 409, 460; 33/174 F; 264/DIG. 66

[56] References Cited

U.S. PATENT DOCUMENTS

| | | | |
|---|---|---|---|
| 2,763,027 | 9/1956 | Tampke | 70/460 |
| 3,475,934 | 11/1969 | Reisner | 70/395 |
| 4,300,416 | 11/1981 | Ross | 70/394 |

*Primary Examiner*—Robert L. Wolfe

*Attorney, Agent, or Firm*—Robert F. Delbridge; Arne I. Fors

[57] ABSTRACT

A key kit for opening tumbler locks has a key member with a shaft insertable into a tumbler lock, the shaft having a series of longitudinally-spaced recesses into which the tumblers in the lock can respectively enter. A foil of impressionable material is removably positionable on the shaft over the recesses, and a tumbler displacing member is insertable into the lock with the shaft and foil to displace the tumblers without the tumblers engaging the foil. The tumbler displacing member being removable from the lock after the shaft and foil have been inserted therein to enable the key member to be manipulated to cause the tumblers to make impressions in the foil corresponding to the key shape required to open the lock.

11 Claims, 14 Drawing Figures

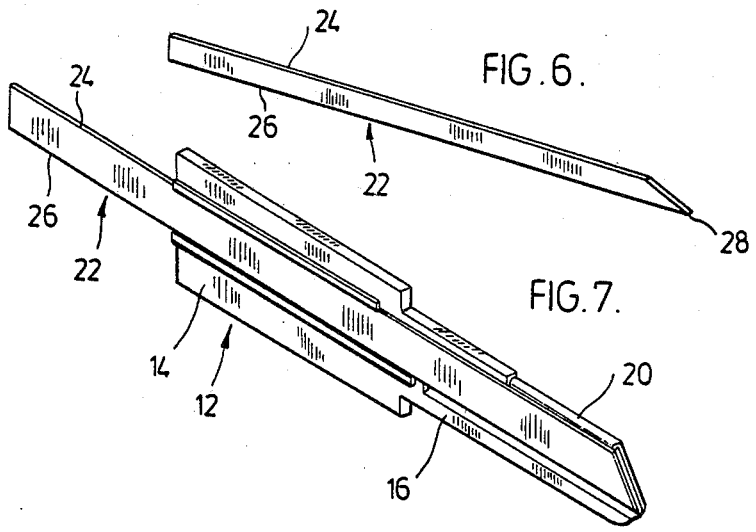
FIG. 6.
FIG. 7.
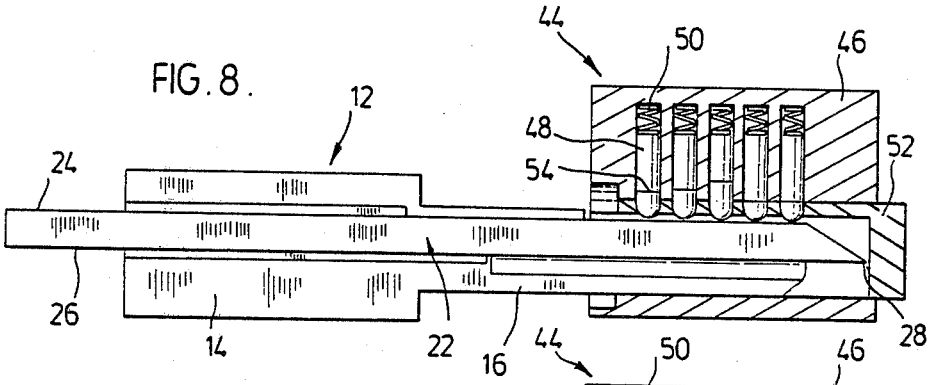
FIG. 8.
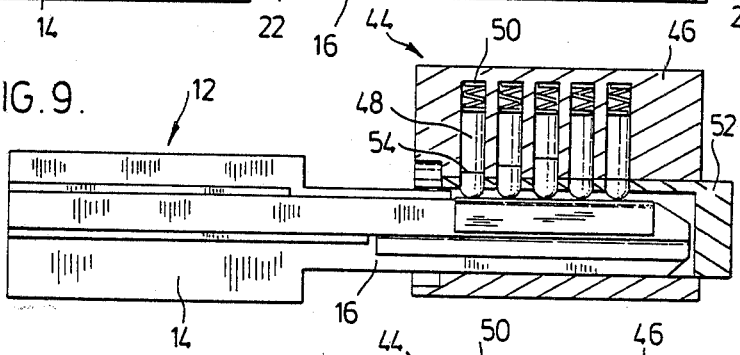
FIG. 9.
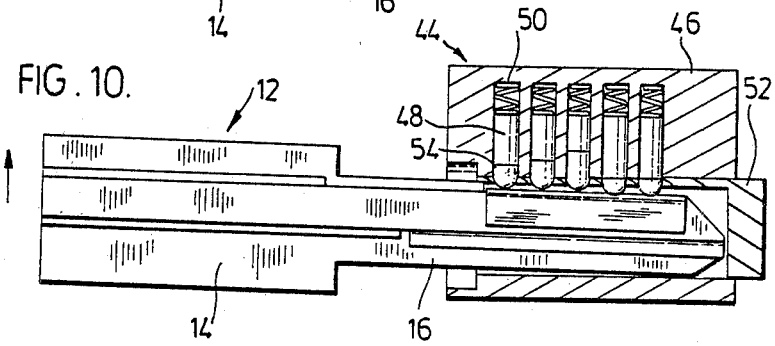
FIG. 10.

FIG. 11.
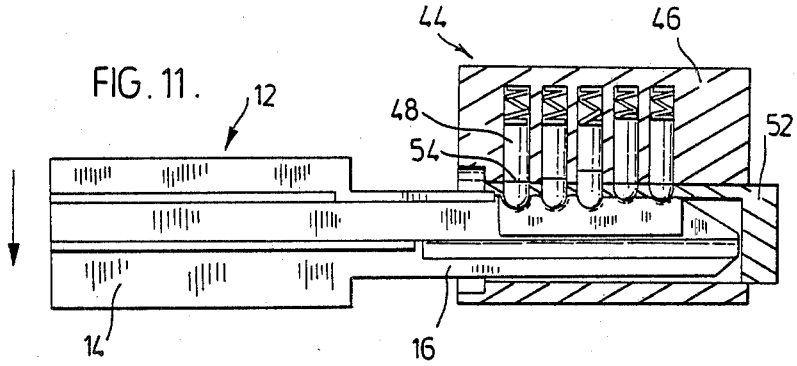
FIG. 12.
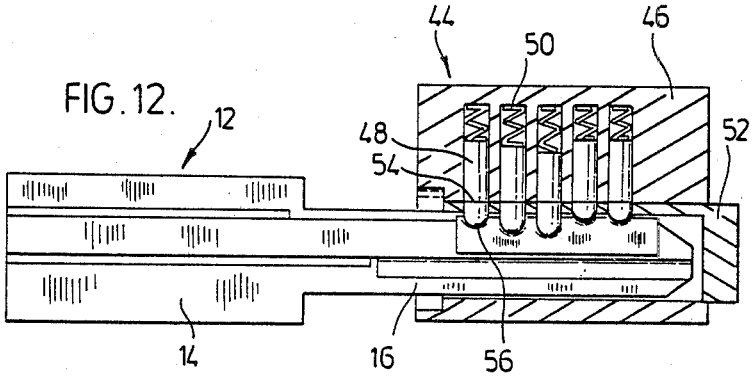
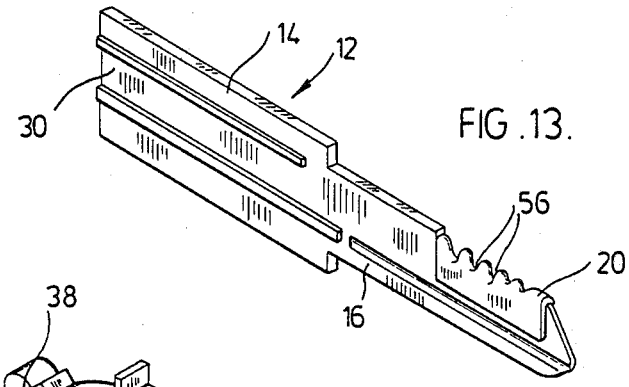
FIG. 13.
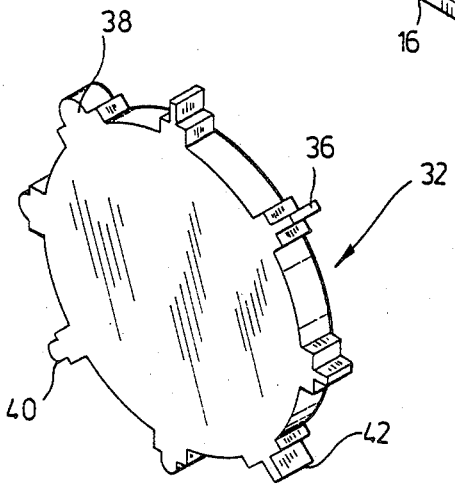
FIG. 14.

SKELETON KEY KIT

This invention relates to a method and a key kit for opening tumbler locks.

The loss of a key to open a lock is a fairly common occurrence. For example, the key to an automobile door lock may be lost in several ways, such as by inadvertance some place away from the car, by accidentally locking the key in the car or by theft. Keys to a home or office lock or to any other lock may be similarly lost. Most of such locks are tumbler locks with pin or wafer tumblers, with some such locks having tumblers which move vertically and others having tumblers which move horizontally.

When a key is lost, either the lock or its surrounding structure has to be damaged to open the locked article or alternatively a replacement key must be obtained. Clearly, the obtaining of a replacement key is preferable to damaging the lock or the locked article. However, unless the user is aware of the tumbler code of the lock concerned, it is necessary for the services of a locksmith to be obtained.

With tumbler locks, a common procedure followed by a locksmith to open a lock is to insert a blank key and manipulate the key to cause the tumblers to make indentations on the blank. By inspecting the indentations, a skilled locksmith can file the blank accordingly. The procedure is repeated until the correct key shape is produced on the blank. However, this is a time consuming and difficult operation.

Lock opening tools are known which include a series of tensioned wires, but such tools are only useful with a limited range of tumbler locks.

It is therefore an object of the invention to provide improved means for opening tumbler locks which overcomes the above mentioned disadvantages.

According to the present invention, a tumbler lock is opened by use of a key bit comprising a key member with a shaft insertable into the lock, the shaft having a series of longitudinally-spaced recesses into which the tumblers in the lock can respectively enter, a foil of impressionable material removably positionable on the shaft over the recesses, and a tumbler displacing member insertable into the lock with the shaft and foil to displace the tumblers without the tumblers engaging the foil. The shaft, foil and tumbler displacing member are inserted into the lock to displace the tumblers, the tumbler displacing member is removed, and the shaft and foil are manipulated to cause the tumblers to make impressions in the foil corresponding to the key shape required to open the lock. The lock can therefore then be opened.

The foil may be a metallic foil, such as a lead foil, and the foil may have one side coated with a pressure sensitive adhesive to enable the foil to be removably secured to the shaft of the key member.

The shaft and foil may be removed from the lock by reinserting the tumbler displacing member to displace the tumblers away from the shaft and foil, and then removing the shaft, foil and tumbler displacing member from the lock.

The key kit may also include an impression gauge having a series of projections insertable into the recesses in the shaft of the key member, the projections being of different sizes corresponding to the possible different opening positions of the tumblers in the lock to enable the gauge to be used to determine the depth of impressions in the foil made by the tumblers.

An embodiment of the invention will now be described, by way of example, with reference to the accompanying drawings of which:

Figure 1:
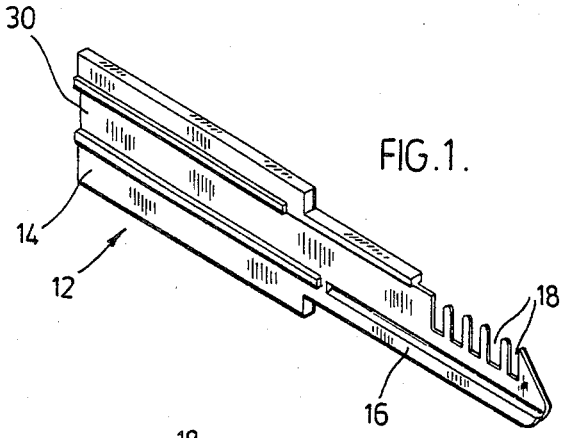
FIG. 1 is a perspective view of a key member from one side thereof.
Figure 2:
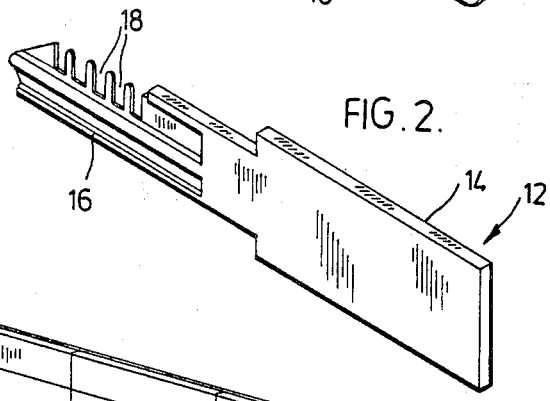
FIG. 2 is a similar view of the key member from the other side.
Figure 3:
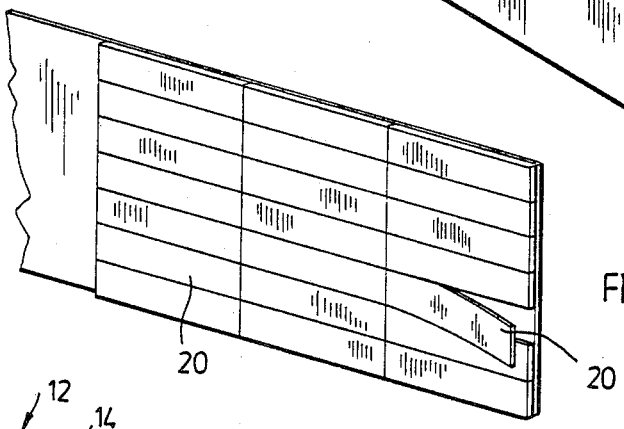
FIG. 3 is a perspective view of a lead foil.
Figure 4:
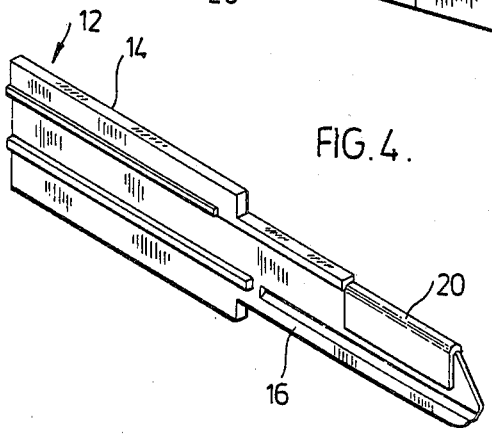
Figure 5:
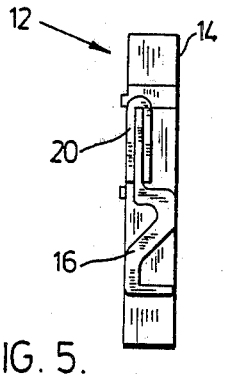

FIG. 4 is a perspective view similar to FIG. 1 showing the foil positioned on the shaft of the key member, FIG. 5 is a front end view of the assembly of FIG. 4, FIG. 6 is a perspective view of a tumbler displacing member, FIG. 7 is a perspective view similar to FIG. 4 showing the tumbler displacing member assembled with the key member, FIG. 8 is a sectional side view of a tumbler lock showing the key member, foil and tumbler displacing member after insertion therein, FIG. 9 is a similar view after the tumbler displacing member has been removed, FIG. 10 is a similar view showing the key member and foil in an upwardly rocked position after partial rotation, FIG. 11 is a similar view showing the key member and foil in a downwardly rocked position, FIG. 12 is a similar view showing the foil after deformation by the tumblers to the extent necessary to open the lock, FIG. 13 is a perspective view of the key member and deformed foil after removal from the lock, and FIG. 14 is a perspective view of the gauge for determining the depth of the impressions in the foil.

Referring first to FIGS. 1 to 7 of the drawings, a key kit for opening tubular locks comprises a key member 12 of any suitable rigid material such as a synthetic plastic material. The key member 12 has a manually grippable head 14 and a shaft 16 extending therefrom, the shaft being shaped to fit into a pin tumbler lock. The shaft 16 has a series of longitudinally spaced recesses 18 at least equal in number to the number of tumblers in the lock with which the key kit is intended to be used, there being five recesses 18 in this embodiment. The size of each recess 18 is such that a tumbler can move to its fully extended position therein.

The key kit also comprises a number of rectangular lead foils 20 with a length slightly greater than the length of the shaft 16 over which the recesses 18 extend, and a width slightly greater than twice the depth of the recesses 18. The foil 20 has a pressure sensitive adhesive on one side, and for use in folded about its longitudinal centre line with the adhesive inwardly. The folded foil is then placed on the shaft 16 over the recesses 18 with the adhesive retaining the foil 20 in place.

The key kit also comprises a tumbler displacing member 22 of suitable material such as steel, the tumbler displacing member 22 being in the form of an elongated thin strip with straight upper and lower edges 24, 26 and a pointed front end 28. The key member 12 has a longitudinal extending groove 30 in one side into which the tumbler displacing member 22 fits so that its upper edge 24 projects above the recesses 18 and foil 20.

The fourth component of the key kit is a depth gauge 32 (see FIG. 14) which has a generally circular body 34 with various projections 36 to 43. The projections are of different sizes corresponding to the sizes of the impressions which will be made in the foil 20 by the different tumblers in their opening positions. The projections 36 to 43 are numbered 2, 3, 4 and 5 etc., the number 1 being reserved for zero impression.

The use of the key kit will now be described with reference to FIGS. 8 to 14. A typical pin tumbler lock 44 has a body 46 containing five tumblers 48 resiliently urged downwardly by springs 50 into a barrel 52. Each tumbler 48 is split into upper and lower portions at a parting line 54, with the parting lines 54 being at different levels for different tumblers.

The foil 20 is mounted on the shaft 16 of the key member 12, and the tumbler displacing member 22 is positioned in the groove 30 of the key member 12 such that the upper edge 24 of the tumbler displacing member 22 extends above the foil 20. The assembly is then inserted into the lock 44 as shown in FIG. 8, with the tumbler displacing member 22 displacing the tumblers 48 upwardly the fullest amount, without the tumblers 48 engaging the foil 20. At least some of the parting lines 54 are consequently out of alignment with the circumference of the barrel 52 so that the barrel 52 cannot be turned by the key assembly. The tumbler displacing member 22 is then slid out of the lock 44 and completely removed, so that the tumblers 48 then rest on the foil 20 over the respective recesses 18 in the shaft 16 of the key member 12, as shown in FIG. 9.

The key member 12 is then rotated slightly in the lock opening direction, such that any tumblers 48 whose parting lines 54 are not aligned with the circumference of the barrel 54 will bear against the barrel 54 and lock body 46. Any tumblers 48 whose parting lines 54 are aligned with the circumference of the barrel 54 will not bear against the barrel 54 or the lock body 46. For the lock shown, the parting lines 54 of the first three tumblers 48 are out of alignment with the barrel circumference, and the parting lines 54 of the last two tumblers 48 are in alignment with the barrel circumference.

While in its slightly rotated position, the key member 12 is rocked up and down, as indicated in FIGS. 10 and 11. The first three tumblers 48 cannot easily move up and down so the lower ends of these tumblers deform the lead foil 20 and make impressions therein. The last two tumblers 48 do move easily up and down and hence do not make any impressions in the foil. The key member 12 is then rotated back to its original position to allow the first three tumblers 48 to move downwardly into the impressions in the foil. The steps just described are repeated until the first three tumblers 48 have made impressions 56 in the foil 20 of such depth that, upon rotating the key member 12 back to its starting orientation, the parting lines 54 are aligned with the barrel circumference, as shown in FIG. 12. The lock 44 can be opened by turning the key member 12 in a normal manner.

To remove the key member 12 and attached foil 20 from the lock 44, the tumbler displacing member 22 is reinserted into the lock along the groove 30 in the key member 12 to displace the tumblers 48 upwardly away from the foil 20. This tumbler is then removed, with the foil 20 on the shaft 16 of the key member 12 appearing as shown in FIG. 13. The depth of each impression 56 is then measured with the gauge 32 to identify the depth as 2, 3, 4 or 5, with 1 being the code applied to no impression as is the case with the last two tumblers 48 in this embodiment. A new key can then readily be made once this code has been determined.

It will be apparent that the foil may be made of other impressionable material then lead foil, the requirement being that the foil is sufficiently rigid to resist impression by the tumblers 48 under the action of the springs 50, but is deformable by the tumblers 48 when wedged in the barrel by partial rotation of the key member 12 and subsequently rocked upwardly and downwardly. Thus, in this application, the term "foil of impressionable material" means a foil which meets these criteria.

The advantages of the described embodiment will be readily appreciated by a person skilled in the art and other embodiments will be clearly apparent, the scope of the invention being defined in the appended claims.

What I claim is:

1. A key kit for opening tumbler locks comprising a key member having a shaft insertable into a tumbler lock, said shaft having a series of longitudinally-spaced recesses into which the tumblers in the lock can respectively enter, a foil of impressionable material removably positionable on the shaft over the recesses, and a tumbler displacing member insertable into the lock with the shaft and foil to displace the tumblers without the tumblers engaging the foil, said tumbler displacing member being removable from the lock after the shaft and foil have been inserted therein to enable the key member to be manipulated to cause the tumblers to make impressions in the foil corresponding to the key shape required to open the lock.

2. A key kit according to claim 1 wherein the foil is a metallic foil.

3. A key kit according to claim 2 wherein the foil is a lead foil.

4. A key kit according to claim 1 wherein the foil has one side coated with a pressure sensitive adhesive to enable the foil to be removably secured to the shaft of the key member.

5. A key kit according to claim 1 also comprising an impression gauge having a series of projections insertable into the recesses in the shaft of the key member, said projections being of different sizes corresponding to the possible different opening positions of the tumblers in the lock to enable the gauge to be used to determine the depth of impressions in the foil made by the tumblers.

6. A method of opening a tubular lock comprising providing a key member having a shaft insertable into the lock, said shaft having a series of longitudinally-spaced recesses into which the tumblers in the lock can respectively enter, a foil of impressionable material removably positioned on the shaft over the recesses, and a tumbler displacing member insertable into the lock with the shaft and foil to displace the tumblers without the tumblers engaging the foil, the method comprising inserting the shaft, foil and tumbler displacing member into the lock to displace the tumblers, removing the tumbler displacing member, manipulating the shaft and foil to cause the tumblers to make impressions in the foil corresponding to the key shape required to open the lock, and turning the key member to open the lock.

7. A method according to claim 6 further including the steps of reinserting the tumbler displacing member to displace the tumblers away from the shaft and foil, and removing the shaft, foil and tumbler displacing member from the lock.

8. A method according to claim 6 wherein the foil is a metallic foil.

9. A method according to claim 8 wherein the foil is a lead foil.

10. A method according to claim 6 wherein the foil has one side coated with a pressure sensitive adhesive to enable the foil to be removably secured to the shaft of the key member.

11. A method according to claim 6 comprising also providing an impression gauge having a series of projections insertable into the recesses in the shaft of the key member, said projections being of different sizes corresponding to the possible different opening positions of the tumblers in the lock, the method comprising using the gauge to determine the depth of the impressions in the foil made by the tumblers.

* * * * *